US006335672B1

(12) United States Patent
Tumlin et al.

(10) Patent No.: US 6,335,672 B1
(45) Date of Patent: Jan. 1, 2002

(54) HOLDER FOR FERRITE NOISE SUPPRESSOR

(75) Inventors: Ricky W. Tumlin, Acworth; J. Larry Underwood, Kennesaw, both of GA (US)

(73) Assignee: L.L. Culmat LP, Woodstock, GA (US)

( * ) Notice: Subject to any disclaimer, the term of this patent is extended or adjusted under 35 U.S.C. 154(b) by 0 days.

(21) Appl. No.: 09/455,695

(22) Filed: Dec. 7, 1999

Related U.S. Application Data

(60) Provisional application No. 60/113,457, filed on Dec. 23, 1998.

(51) Int. Cl.[7] ..... H01F 17/06

(52) U.S. Cl. ..... 336/175; 336/65

(58) Field of Search ..... 336/174, 175, 336/92, 176, 90, 212, 210; 174/92; 324/127

(56) References Cited

U.S. PATENT DOCUMENTS

| | | | | |
|---|---|---|---|---|
| 2,894,056 | A | | 7/1959 | Bogese |
| 2,908,744 | A | | 10/1959 | Bollmeier |
| 3,757,031 | A | * | 9/1973 | Izraeli ..... 174/92 |
| 4,219,693 | A | | 8/1980 | French |
| 4,426,108 | A | | 1/1984 | Kesselman |
| 4,535,197 | A | | 8/1985 | Butler |
| 4,647,715 | A | | 3/1987 | Butler |
| 4,818,957 | A | | 4/1989 | Cort |
| 4,825,185 | A | | 4/1989 | Matsui |
| 4,882,561 | A | | 11/1989 | Fujioka |
| 4,954,940 | A | | 9/1990 | Chandler et al. |
| 4,964,012 | A | | 10/1990 | Kitagawa |
| 4,964,013 | A | | 10/1990 | Kitagawa |
| 4,972,167 | A | * | 11/1990 | Fujioka ..... 336/92 |
| 4,983,932 | A | | 1/1991 | Kitagawa |
| 5,003,278 | A | | 3/1991 | May |
| 5,017,739 | A | | 5/1991 | Hoffman et al. |
| D326,646 | S | | 6/1992 | Matsui |
| 5,162,772 | A | * | 11/1992 | May ..... 336/92 |
| 5,264,814 | A | | 11/1993 | Yamazaki et al. |
| 5,291,172 | A | | 3/1994 | Ito et al. |
| 5,334,955 | A | | 8/1994 | Strnad |
| 5,355,109 | A | | 10/1994 | Yamazaki |
| 5,502,374 | A | | 3/1996 | Cota |
| 5,506,909 | A | | 4/1996 | Perng |
| 5,530,634 | A | | 6/1996 | Smith |
| 5,537,087 | A | | 7/1996 | Naito |
| 5,610,370 | A | | 3/1997 | Fremgen et al. |
| 5,764,125 | A | | 6/1998 | May |
| 5,821,845 | A | | 10/1998 | Ohashi |
| 5,900,796 | A | | 5/1999 | Parker |
| 5,920,250 | A | | 7/1999 | Watanabe et al. |
| 5,942,964 | A | | 8/1999 | Takeuchi |
| 5,990,756 | A | | 11/1999 | France, Jr. et al. |
| 6,023,023 | A | | 2/2000 | Takeuchi |
| 6,144,277 | A | | 11/2000 | Matsui et al. |
| 6,160,466 | A | | 12/2000 | Kawai ..... |

* cited by examiner

*Primary Examiner*—Lincoln Donovan
*Assistant Examiner*—Tuyen T. Nguyen
(74) *Attorney, Agent, or Firm*—Brinks Hofer Gilson & Lione

(57) ABSTRACT

A holder for containing a split ferrite suppressor includes two halves hinged to each other along one side, each half including a recess adapted to hold one portion of a split ferrite suppressor. Each half of the holder also includes two ends, each end containing a generally semicircular notch adapted to receive a cable to which the suppressor is to be applied, and locking tabs disposed on both sides of the semicircular notch for locking the two halves of the holder together. The locking tabs are preferably arranged as confronting mating pairs of male and female elements, each element having a head portion and a neck portion smaller than the head portion. The interlocking tabs preferably include tapering surfaces connecting the head and neck portions, the tapering surfaces applying a biasing force tending to hold the two halves of the holder together. The tapering surfaces are preferably substantially planar surfaces inclined at about 10° with respect to a line bifurcating said head and neck portions.

9 Claims, 3 Drawing Sheets

HOLDER FOR FERRITE NOISE SUPPRESSOR

CROSS REFERENCE TO RELATED APPLICATION

The present application is related to United States Provisional Application Ser. No. 60/113,457 filed Dec. 23, 1998.

BACKGROUND OF THE INVENTION

The present invention relates generally to ferrite suppressors for suppressing high frequency noise in electrical cables, and more particularly to holders for such ferrite suppressors as are designed to encompass the electrical cable and be locked in position about the cable by way of integrally molded tabs included in the holders.

Typical ferrite suppressors are manufactured of ferrous oxide material that is formed into the shape of a cylinder having a hole aligned with the major axis of revolution of the cylinder for receiving an electrical cable. Electrical cables, whether intended to carry power or for communication, can act as antennas that pick up spurious noise signals from various sources. The ferrite suppressors are employed in close proximity to electrical equipment to which the electrical cables are attached to screen the electrical equipment from the spurious signals while allowing desirable signals to pass through.

The ferrite suppressors are typically split or bifurcated along the major axis of revolution so that the suppressors can be joined over the desired location on the electrical cable rather than requiring that the cable be threaded through to the desired position. The bifurcated halves of the ferrite suppressors can be secured in position using any number of techniques. Increasingly, the bifurcated halves are secured in position through the use of special holders that are designed to receive the two halves and snap together around the electrical cable. Examples of prior art holders are to be found in U.S. Pat. Nos. 5,355,109; 5,162,772; 5,003,278; 4,882,561; and 4,825,185.

The prior art holders generally have two halves, with each half of the holder intended to receive one half of the ferrite suppressor. Each half includes two ends, each end containing a generally semicircular notch adapted to receive a cable to which the suppressor is to be applied. In many of the prior art holders, the two halves of the holder are typically molded as a single unit and include a molded living hinge along a first side parallel to the major axis of revolution of the suppressor. The first sides of the two halves are maintained in close proximity to each other by the living hinge while the second sides of the two halves, which are farthest from the living hinge, can swing toward and away from each other. In a typical holder of the prior art, the second sides include interlocking tabs or other complementary structures that secure the two halves of the holder together around the electrical cable.

The proper dimensioning of the hinge portion joining the first sides of the two halves together often presents an appreciable problem that must take into account both the geometry of the situation and the stiffness or flexibility of the resin employed to form the holder. If the hinge is too short, the hinge may not provide sufficient flexibility to permit the holder to close around the electrical cable. If the hinge is too long, the holder and ferrite suppressor may be inadequately secured to the electrical cable. To address this problem prior art holders have included a plurality of fingers or pinching members in the immediate vicinity of the semicircular notches in the ends of the holder to ensure fixed engagement with the electrical cable over some modest range of dimensions. While such structures are generally satisfactory to achieve retention of the ferrite suppressor at a fixed location on an electrical cable, the pressures exerted on the cable can still be unbalanced if the dimension of the hinge is not carefully selected.

It is therefore an object of the present invention to reduce the criticality of the hinge dimension. It is a further object to provide a balanced force on both sides of the electrical cable to which the ferrite suppressor holder is secured.

SUMMARY OF THE INVENTION

A holder of the present invention for containing a split ferrite suppressor includes two halves hinged to each other along one side. Each half includes a recess adapted to hold one portion of the split ferrite suppressor. Each half also includes two ends, each end containing a generally semicircular notch adapted to receive a cable to which the suppressor is to be applied. The ends also have locking tabs disposed on both side of the semicircular notch for locking the two halves of the holder together.

The locking tabs are preferably arranged as confronting mating pairs of male and female elements, each element having a head portion and a neck portion smaller than the head portion. The interlocking tabs preferably include tapering surfaces connecting the head and neck portions, the tapering surfaces applying a biasing force tending to hold the two halves of the holder together. The tapering surfaces are preferably substantially planar surfaces inclined at about 10° with respect to a line bifurcating said head and neck portions.

In one embodiment of the holder of the present invention, the male elements are all located on one half and the female elements are all located on the other half. In the preferred embodiment of the present invention, the head portion of each of the male and female elements is about 20% larger than the neck portion.

The holder of the present invention preferably includes a plurality of resilient fingers inclined outwardly from each semicircular notch, each resilient finger having a rounded end for engaging a cable to which the suppressor is applied to resist longitudinal movement of the suppressor with respect to the cable.

An important feature of the present invention is the presence of locking tabs disposed on both side of the semicircular notch in both ends of the holder for locking the two halves of the holder together. This disposition of locking tabs has the advantage of balancing the force applied to the electrical cable to which the ferrite suppressor holder is secured. This feature is enhanced by the incorporation of the plurality of resilient fingers inclined outwardly from each semicircular notch for engaging the electrical cable to which the suppressor is applied. Other features and advantages of the present invention will become apparent to those skilled in the art upon consideration of the following description of the preferred embodiment of the invention shown in the accompanying drawings.

DESCRIPTION OF THE PREFERRED EMBODIMENT

Figure 1:
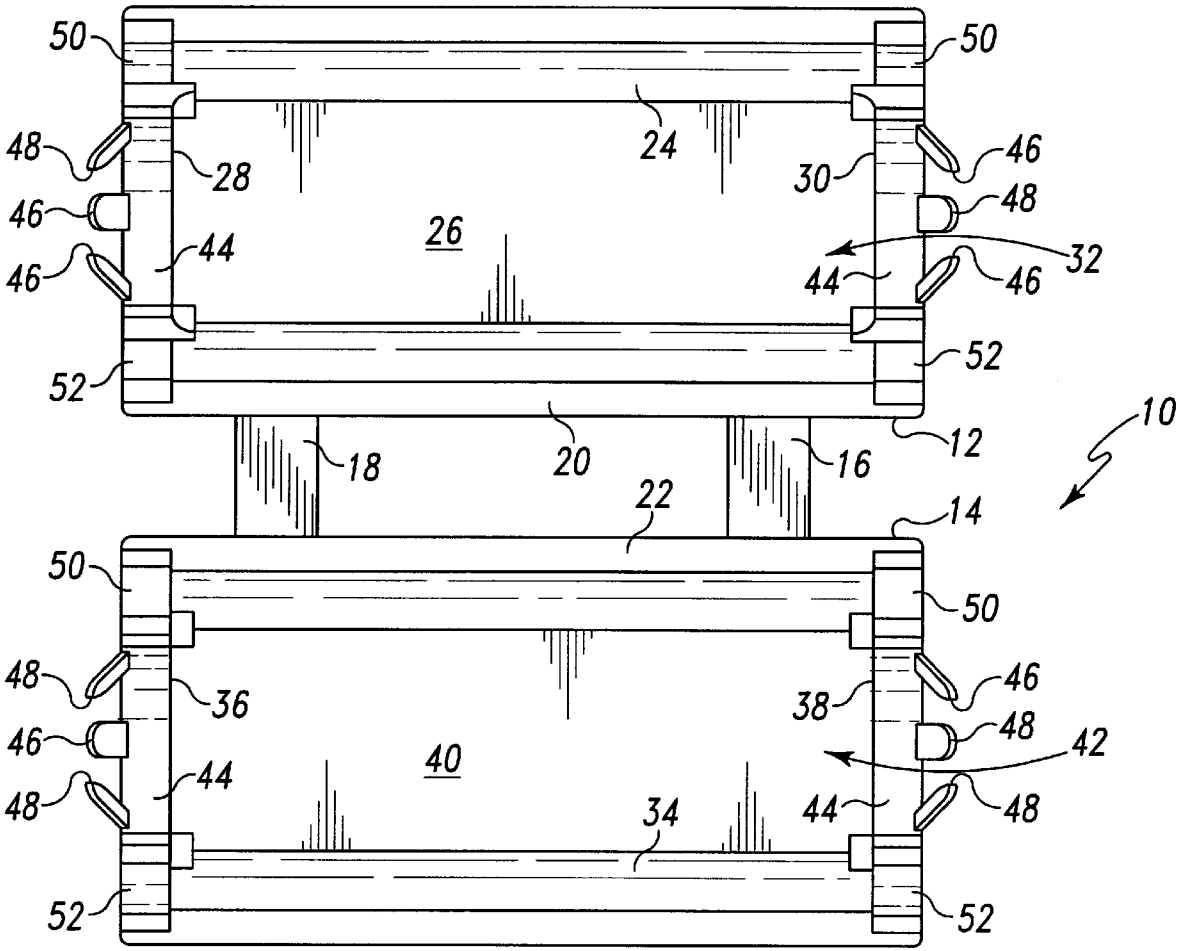
FIG. 1 is a plan view of a holder for a ferrite suppressor in accordance with the present invention.
Figure 2:
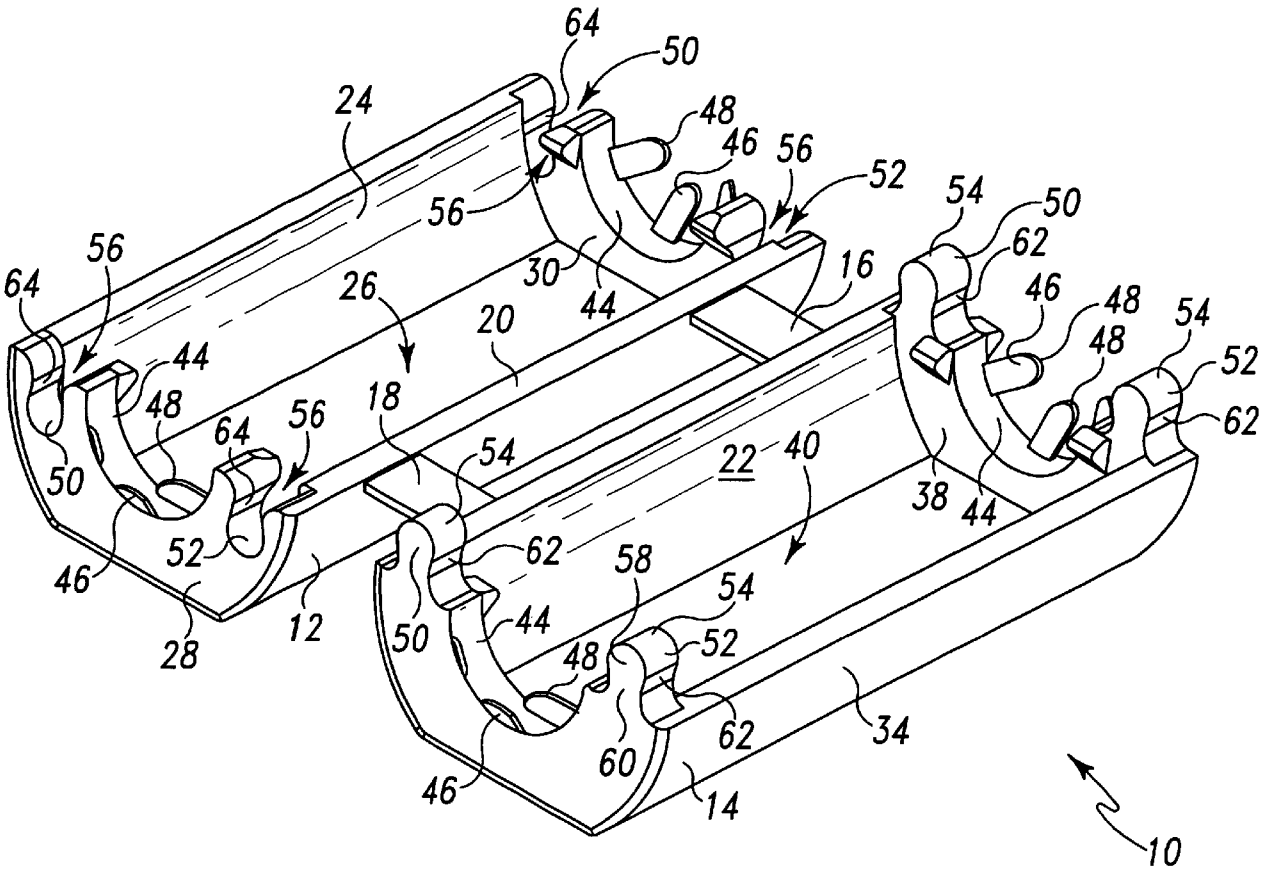
FIG. 2 is a perspective view of the holder shown in FIG. 1.
Figure 3:
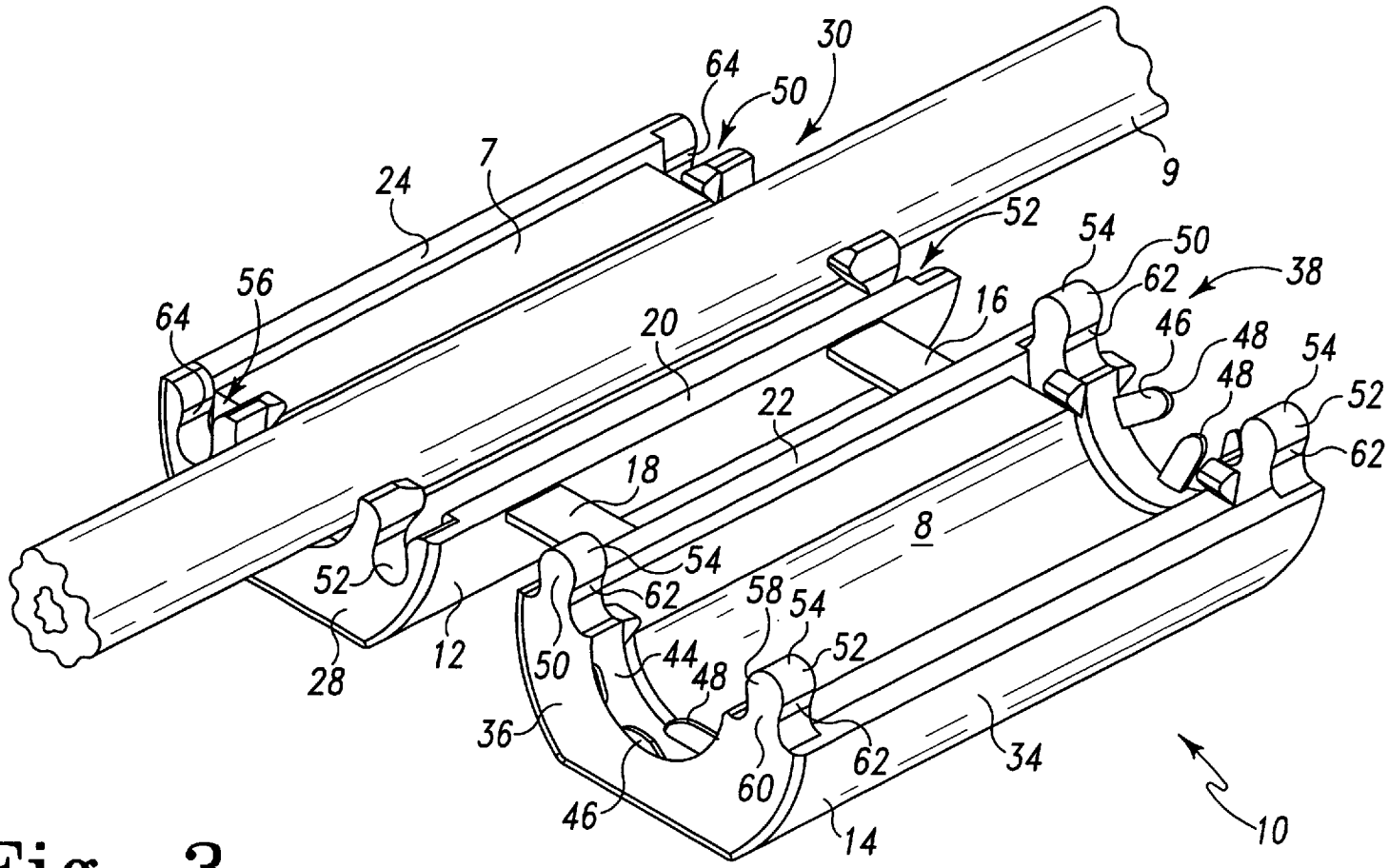
FIG. 3 is a perspective view of the holder, similar to FIG. 2, with split ferrite suppressor sections installed in the holder and receiving an electrical cable.

A holder 10 of the present invention is shown in FIGS. 1 and 2 to include two halves 12 and 14 coupled together by a pair of hinge elements 16 and 18. The hinge elements 16 and 18 are connected to a first side 20 and 22 of halves 12 and 14, respectively. The first half 12 of holder 10 includes a second side 24 arranged generally parallel to side 20. The sides 20 and 24 are joined together by a bottom 26 as well as ends 28 and 30. The sides 20 and 24, ends 28 and 30, and bottom 26, when taken together, define a recess 32 adapted to hold one portion of a split ferrite suppressor 7 as shown in FIG. 3. The second half 14 is similarly constructed to include a second side 34 generally parallel to first side 22, ends 36 and 38, and bottom 40 which, when taken together, define another recess 42 adapted to hold a second portion of a split ferrite suppressor 8 as shown in FIG. 3.

The ends 28, 30, 36 and 38 include a generally semi-circular notch 44 adapted to receive an electrical cable 9 as shown in FIG. 3 to which the ferrite suppressor 7 and 8, and holder 10 is to be applied. A plurality of resilient fingers 46 extend inwardly from each semi-circular notch 44 to engage the cable 9 to which the suppressor 7 and 8 and holder 10 is to be applied to resist longitudinal movement of the suppressor and holder with respect to the cable. The resilient fingers 46 are inclined longitudinally outwardly and include rounded ends 48 for engaging the electrical cable 9.

Each of the two ends also includes locking tabs 50 and 52 which are disposed on both sides of the semi-circular notch 44 for locking the two halves 12 and 14 of the holder 10 together as a single unit about the electrical cable. This balance disposition of the locking tabs 50 and 52 on both sides of the semi-circular notch 44 in both ends of the holder 10 has the advantage of balancing the force applied to the electrical cable by the ferrite suppressor holder 10. The employment of locking tabs 50 and 52 on both sides of the semi-circular notch 44 diminishes the criticality of length or other dimension of the hinges 16 and 18 as compared to prior art devices.

As best seen in FIG. 2, the locking tabs 50 and 52 are arranged so that when the holder is pivoted about hinges 16 and 18 to a closed position as shown by arrow A, the locking tabs comprise confronting mating pairs of male and female elements. The male elements 54 are shown to be confined to the second half 14 of the holder 10 while the female locking elements 56 are shown to be confined to the first half 12 of the holder 10. It will be appreciated that the disposition of the male and female elements is a matter of choice of design and the elements could be found in any mixed arrangement on either path so long as the confronting pairs of elements were appropriately complementary to permit closure of the two halves 12 and 14.

In the preferred embodiment, the male and female elements 54 and 56 each have a head portion 58 which is larger in width than the neck portion 60. In the preferred embodiment, the width of the head portion is about 20% larger than the neck portion although the specific size is subject to variation and design depending on the physical characteristics of the resin employed in manufacturing the holder. In the preferred embodiment, the holder 10 is constructed of a polypropylene polymer.

It is additionally preferable that the interlocking tabs 54 and 56 include tapering surfaces 62 and 64 which are substantially planar and incline at an angle of about 10° with respect to a line bifurcating the head and neck portions.

While the present invention has been described in detail with the illustrated preferred embodiment shown in the accompanying figures, it will be understood that the invention may be embodied in other structures not departing from the principles of the invention as described and as defined in the following claims.

What is claimed is:

1. A holder for containing a split ferrite suppressor, the holder comprising: two halves hinged to each other along one side, each half including a recess adapted to hold one portion of the split ferrite suppressor, each half also including two ends, each end containing a generally semicircular notch adapted to receive a cable to which the suppressor is to be applied, the ends also having locking tabs located on both sides of each semicircular notch for locking the two halves of the holder together.

2. The holder of claim 1 wherein the locking tabs are arranged as confronting mating pairs of male and female elements.

3. The holder of claim 2 wherein the male elements are all located on one half and the female elements are all located on the other half.

4. The holder of claim 2 wherein each element includes a head portion and a neck portion smaller than the head portion.

5. The holder of claim 4 wherein the head portion of each of the male and female elements is about 20% larger than the neck portion.

6. The holder of claim 4 wherein each element includes tapering surfaces connecting the head and neck portions.

7. The holder of claim 6 wherein said tapering surfaces are substantially planar surfaces inclined at about 10° with respect to a line bifurcating said head and neck portions.

8. The holder of claim 1 further comprising a plurality of resilient fingers inclined outwardly from each semicircular notch, each resilient finger having a rounded end for engaging a cable to which the suppressor is applied to resist longitudinal movement of the suppressor with respect to the cable.

9. A holder for containing a split ferrite suppressor, the holder comprising: two halves hinged to each other along one side, each half including a recess adapted to hold one portion of the split ferrite suppressor, each half also including two ends, each end containing a generally semicircular notch adapted to receive a cable to which the suppressor is to be applied, the ends also having interlocking tabs for locking the two halves of the holder together, the interlocking tabs being arranged as confronting mating pairs of male and female elements, each element having a head portion and a neck portion smaller than the head portion and including tapering surfaces connecting the head and neck portions, the tapering surfaces applying a biasing force tending to hold the two halves of the holder together.

* * * * *